United States Patent [19]

Tafelski, Jr.

[11] Patent Number: 4,628,645

[45] Date of Patent: Dec. 16, 1986

[54] PORTABLE DECK

[76] Inventor: Roman J. Tafelski, Jr., 6235 Schaefer Rd., Dearborn, Mich. 48216

[21] Appl. No.: 610,315

[22] Filed: May 14, 1984

[51] Int. Cl.[4] ..... E04B 5/52

[52] U.S. Cl. ..... 52/169.1; 52/102; 52/477; 52/666; 404/43

[58] Field of Search ..... 52/169.1, 177, 477, 52/102, 666, 780; 404/43

[56] References Cited

U.S. PATENT DOCUMENTS

| | | | |
|---|---|---|---|
| 368,398 | 8/1887 | Hoyt | 52/477 X |
| 423,126 | 3/1890 | Carman . | |
| 629,951 | 8/1899 | Brown . | |
| 1,645,538 | 10/1927 | MacDonald . | |
| 1,916,494 | 7/1933 | Schrickel | 52/102 X |
| 1,968,189 | 7/1934 | Bartels | 25/41 |
| 2,888,779 | 6/1959 | Hostetter | 52/102 X |
| 3,125,009 | 3/1964 | Eberl | 94/4 |
| 3,157,254 | 11/1964 | Spiselman et al. | 189/34 |
| 3,213,768 | 10/1965 | Jensen | 94/14 |
| 3,300,936 | 1/1967 | Traveglia | 52/477 |
| 3,504,472 | 4/1970 | Clement | 52/169.1 X |
| 3,859,000 | 1/1975 | Webster | 404/41 |
| 4,300,320 | 11/1981 | Rooney | 52/173 |

FOREIGN PATENT DOCUMENTS

| | | | |
|---|---|---|---|
| 207403 | 2/1960 | Austria | 52/223 R |
| 71180 | 3/1942 | Czechoslovakia | 52/477 |
| 1047053 | 12/1953 | France | 52/224 |
| 1567855 | 5/1969 | France | 52/228 |
| 568731 | 11/1957 | Italy | 52/477 |
| 245901 | 1/1926 | United Kingdom | 52/477 |

*Primary Examiner*—William F. Pate, III
*Assistant Examiner*—J. M. LaKemper
*Attorney, Agent, or Firm*—Brooks & Kushman

[57] ABSTRACT

A patio deck construction comprising a frame defining a plurality of apertures adapted to receive a plurality of fixedly dimensioned patio stones in a fixed, level arrangement above a ground surface. Planks forming the frame are notched to form ledges which peripherally support the stones within the apertures. At least one stringer plank extends across the border of the frame so as to increase the rigidity of the frame. Cross planks extend between adjacent stringer planks or a stringer plank and a border plank. Preferably, the planks include notches adapted to receive the end of an intersecting plank to further rigidify the frame. An additional feature comprises a plastic sheet laid under the frame to inhibit the growth of vegetation which can detract from the ornamental appearance of the patio stone deck.

12 Claims, 3 Drawing Figures

PORTABLE DECK

BACKGROUND OF THE INVENTION

I. Field of the Present Invention

Present invention relates generally to static structures for forming a flooring surface and more particularly to a deck structure having a frame adapted to support a plurality of fixedly dimensioned stones to form a patio deck surface.

II. Description of the Prior Art

A patio deck is a well known flooring structure which can be used to increase the living space of a dwelling unit or to provide an attractive entrance way to a building. The patio deck provides a substantially planar floor surface which provides stable footing and enables furniture such as chairs and tables to be stably positioned and repositioned with ease on the flooring area. Perhaps the most common kind of patio deck comprises a cement slab deck made of poured concrete. The construction of such a deck requires substantial preparation of the ground area upon which the concrete is to be poured, and requires the construction of forms into which the concrete can be poured to retain the concrete in position as it hardens. Moreover, the concrete mixture must be properly prepared. Thus, the construction of a concrete deck can be quite time consuming and complex and is beyond the ordinary skill of many home owners. Moreover, once the deck has been constructed, it can not be used immediately, but must be allowed time to harden and cure. In addition, the resulting structure is a permanent installation which can not be transported when a change of residence is desired. Moreover, the removal of such a deck is difficult and time consuming.

Another previously known type of deck construction comprises a wooden deck structure in which the flooring surface is provided by a plurality of planks aligned adjacent to each other across a frame structure. The frame structure is typically supported above the ground surface by support posts which have been embedded in the ground to add rigidity to the structure. In such a deck structure, each plank and framing member must be cut to size and then assembled into position in the deck structure. Thus the construction of such a deck structure is very time consuming and requires a substantial amount of labor.

Another previously known type of patio deck comprises a layer of fixedly dimensioned patio stones placed on a leveled ground surface. Typically, the ground surface is leveled and tamped to provide a stable, smooth surface on which the stone blocks can be supported. Nonetheless, rain water and temperature changes can cause the ground to settle, whereby the floor surface formed by the patio stones can become uneven. Moreover, the temperature changes and moisture changes as well as movement of the stones due to traffic across the patio may cause the stone blocks to become chipped, cracked or misaligned in the patio structure. In addition, weeds and other vegetation can grow in the spaces between the stones. It has also been known to space the stones apart from each other and to fill the interspace between the blocks with soil or other material between the blocks so that they do not brush against each other when subjected to the movement of feet or furniture on the deck surface. However, guide wires must be aligned and positioned and the blocks must be carefully aligned with the wire as they are installed. Moreover, the preparation of the ground surface and placement of the patio stones is quite laborious and time consuming. In addition, it is often necessary to remove sod which has been laid in the area where the deck is desired in order to provide stable but flat support surface for the patio stones.

SUMMARY OF THE PRESENT INVENTION

The present invention overcomes the above mentioned disadvantages by providing a portable deck comprising a frame adapted to rest upon a ground surface and support a plurality of patio stones in a predetermined arrangement to form a substantially flat flooring surface above the ground. The frame includes means for supporting the patio stones at a predetermined height above the ground surface and maintains the positioning of the patio stones even when soil loosens, settles or erodes beneath portions of the deck area. The stones will fixedly retain their position in apertures defined by the frame without the need of tools or sealants. In addition, the stones can easily be removed for replacement or when the patio is to be moved to another area.

In the preferred embodiment of the present invention, the frame is constructed of a plurality of two by six plank sections. A plurality of border planks are secured end to end to form a closed polygonal border. In addition, at least one stringer plank extends across the interior of the polygonal border and is secured to border members so as to define separated apertures extending through the frame. The apertures thus formed can be further divided into additional apertures by cross planks extending between stringer planks or between a stringer plank and a border plank.

The peripheral walls defining each aperture are provided with means for supporting the fixedly dimensioned patio block at the top of each aperture. Preferably, the blocks are supported so that the top surface of each patio block extends slightly above the top of the frame. In the preferred embodiment, the planks are provided with notches in the upper edge of the plank which form a recessed ledge for supporting the periphery of the patio stone in each aperture. The patio stones can be soley supported by the peripheral ledge in each aperture when each patio stone is made of a compacted cement compound and capable of withstanding the forces exerted by occupied furniture or the like without breaking. Alternatively, it will be understood that additional or supplemental means, such as a filler material between the ground surface and the patio block, can be used to resist breakage of the stones.

In the preferred embodiment, the frame is prefabricated to reduce the on-site labor which must be performed to install a deck in accordance with the present invention. Therefore, prior to assembly of the planks, the border planks and stringer planks are provided with recesses adapted to receive the ends of intersecting planks. The recesses are formed at predetermined spaced apart positions corresponding to the size of patio stones intended to be installed in the frame. As a result, the planks are interlocked with each other to form a rigid integral frame structure. When the frame is prefabricated, the installation of a portable deck in accordance with the present invention is readily accomplished by placing the frame on the ground surface, and merely placing the stones in the apertures extending through the frame. Thus, although the frame is transported as an integral structure, the apertures provide a relatively light structure which can be relatively easily transported and positioned. Moreover, since each aperture is dimensioned in a predetermined size corresponding to the size of the patio stones to be used, the frame maintains the alignment of the patio stones and prevents destructive contact between the individual patio stones used to form the deck flooring surface. Nevertheless, since the size of the apertures confines each patio stone in a fixed position, other attachment means, such as mortar, need not be used to secure the stones in position. Accordingly, it will be understood that the patio stones can be lifted and withdrawn from the apertures for replacement of the stone or repositioning of the entire deck structure. Nonetheless, the integral recess structure of the stringer and cross members maintains the rigidity of the frame during transportation, installation and use of the frame.

Thus, the present invention provides a portable deck structure which is easily installed and positioned where desired on an existing ground surface. The deck structure does not require preparation or leveling of the ground surface where the deck is to be positioned, and does not require the removal of sod or soft topsoils which can typically interfere with planar arrangement of patio stones in a patio deck. Moreover, the deck is readily available for use after patio stones have been laid in the apertures of the positioned deck. Moreover, a preferred deck construction according to the present invention includes a grass-trim flange extending outwardly from the frame border to provide a ledge for supporting a lawnmower and positioning the lawnmower blade over the edge of the flange for ease in trimming adjacent lawn areas. These and other advantages will be more fully understood as described in detail hereinafter.

BRIEF DESCRIPTION OF THE DRAWING

The present invention will be more clearly understood by reference to the following detailed description of the preferred embodiment, when read in conjunction with the accompanying drawing in which.

DETAILED DESCRIPTION OF THE PREFERRED EMBODIMENT

Figure 1:
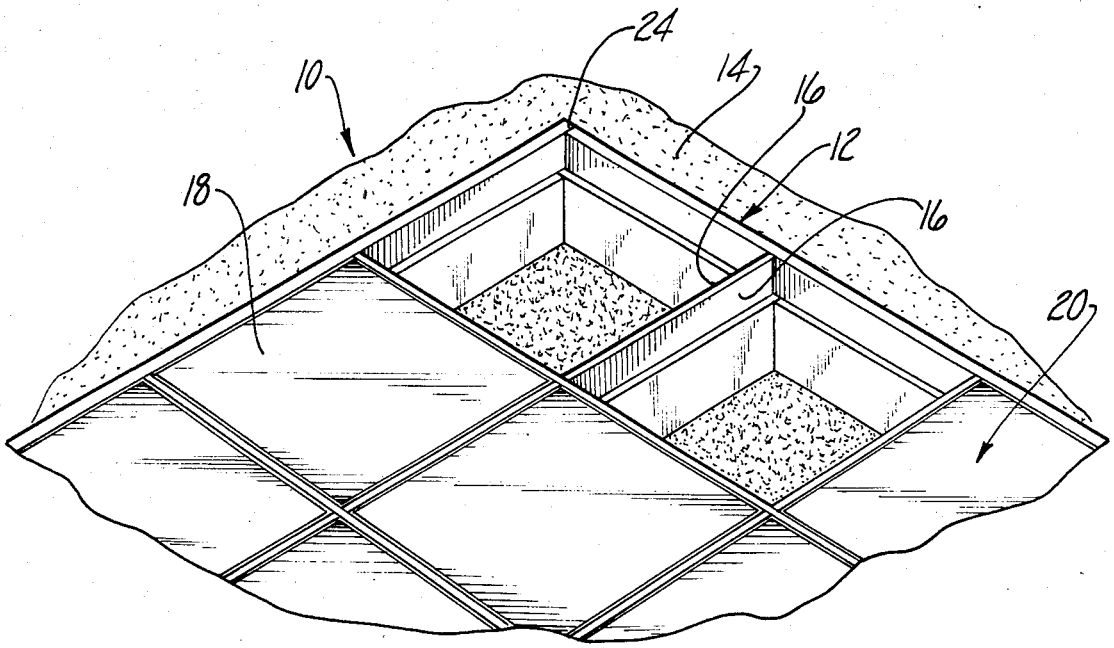
FIG. 1 is a fragmentary perspective view of a deck constructed in accordance with the present invention with portions removed for clarity.
Figure 3:
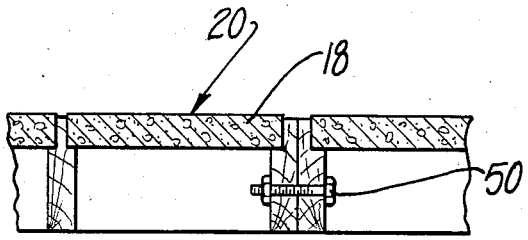
FIG. 3 is a side plan view of a portion of a deck constructed in accordance with the present invention.

Referring first to FIG. 1, a deck structure 10 according to the present invention is thereshown comprising a frame 12 resting upon the ground surface 14. The frame 12 supports a plurality of fixedly dimensioned patio stones 18 in the form of blocks in a level arrangement to form a substantially flat flooring surface 20 above the ground surface 14 as shown in FIGS. 1 and 3. A plurality of apertures 16 defined by the frame 12 are correspondingly dimensioned with respect to the patio stones so that the peripheral wall of each aperture retains the patio stone 18 in a fixed position within the frame 12. In addition, as will be described in greater detail hereinafter, the frame 12 maintains a substantially level arrangement of patio stones 18. The preferred embodiment of the present invention combines the rigidity and stability of a wood deck frame with the decorative appearance of colored patio stones in a deck structure which is substantially easier to assemble than previously known deck structures.

As shown in FIG. 1, the frame 12, as well as the apertures 16 defined by the frame 12 and the patio stones 18, have a rectangular peripheral configuration. While it is also to be understood that other patio stone shapes and frame configurations can be employed in accordance with the present invention, rectangular configurations are used in the preferred embodiment for the reason that rectangular decks are most popular, and rectangular bricks are readily available in a variety of colors. Nevertheless, the overall configuration of the frame can be changed as desired so long as the frame includes peripherally bounded apertures corresponding to the shape and size of the patio blocks to be used.

Moreover, while a variety of stones can be used in the deck construction according to the present invention, the patio stones 18 used in the preferred embodiment of the present invention are made of compressed concrete. Thus, unlike the previously known cement slab decks which are able to withstand surface pressure of approximately 3000 pounds per square inch before cracking, the blocks of the present invention are compacted so as to be able to withstand substantially greater pressures, for example about 4500 pounds per square inch without cracking, even though the stones are relatively thin, for example, one and a half inches tall. Thus, the stones are prestressed concrete blocks which can be supported in cantilever fashion and do not require a stable base beneath the entire surface area of the patio stone. Nonetheless, it will be understood that other types of patio stones can be employed to the deck construction of the present invention since the apertures defined in the frame permit the placement of stands or supports beneath the patio stone supported by the frame of the present invention.

Figure 2:
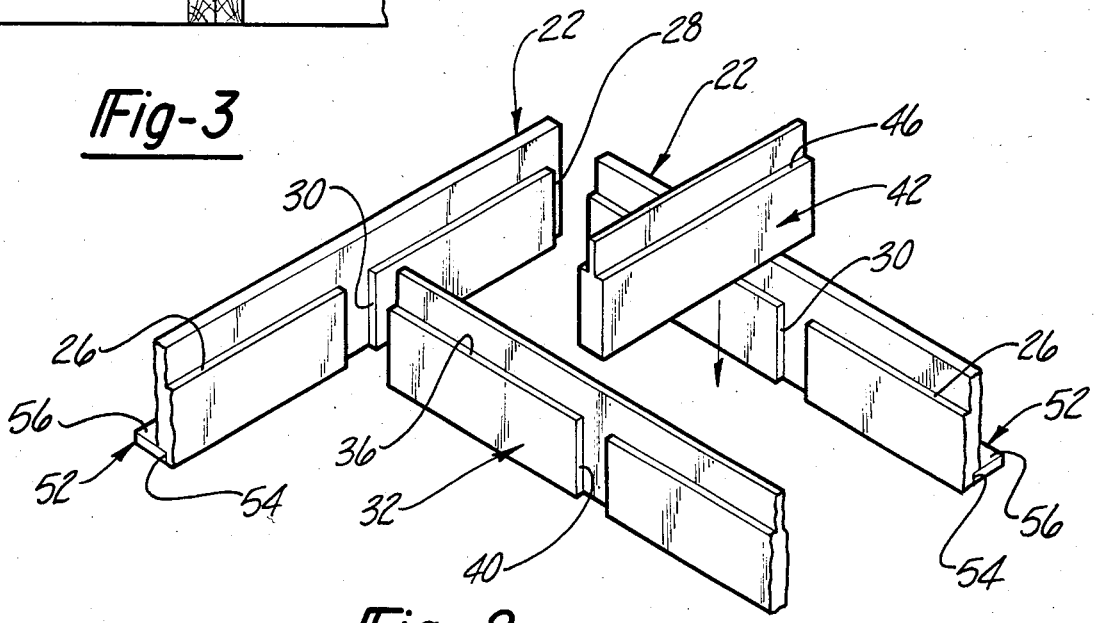
FIG. 2 is an exploded perspective view of the frame structure for the deck shown in FIG. 1.

Referring now to FIG. 2, the frame 12 comprises four border planks 22 (only two shown) which form a rectangular border 24 (FIG. 1). The top of each border plank 22 is notched along one side to predetermined depth to form a ledge 26 extending along the border plank. Two border planks, disposed on opposite sides of the border 24, include vertical recesses 28 at each end to permit the adjacent border plank 22 to butt against and form a square corner with the recessed border plank. In addition, the border planks 22 include vertical recesses 30 spaced apart at predetermined positions in accordance with the size of the stones to be used. The recesses are adapted to receive an end of a stringer plank 42 or a cross plank 34 as will be described in greater detail hereinafter.

At least one stringer plank 32 extends across the border 24. The stringer plank 32 includes an elongated notch along the top edge of each side of the plank to form a ledge 36 along each side of the plank. In addition, vertical recesses 40 are cut into opposite sides of stringer plank 32 at predetermined positions in accordance with the size of stones to be used, and are adapted to receive an end of a cross plank 42.

A plurality of cross planks 42 are sized to extend between a stringer plank and the border plank or between adjacent stringer planks. A notch is formed along the top edge of both sides of cross planks 42 to form ledges 46.

The ledges 26, 36 and 46 in the planks 22, 32 and 42, respectively, are formed at the same height to form a peripheral ledge in each aperture 16. With a pair of border members 22 engaged in recesses 28 of the adjacent border members 22, and with stringer plank 32 positioned within the recesses 30 in the border plank 22, and with the cross planks 42 engaged within the recesses 40 and 30 as shown in FIG. 2, the planks can be fastened together to form a rigid integral structure for the frame 12. Thus, the frame 12 defines a plurality of apertures 16 of predetermined cross sectional shape corresponding with the stones 18 and extending through the frame 12. Preferably, the portions of the plank above the ledges 26, 36 and 46 have a height slightly less than the thickness of the patio stones 18 so that the patio stones extend slightly above the top edge of the planks 22, 32 and 42. Thus, although the top edge of the planks has been narrowed by the formation of notches in the planks, the rigidity of the planks is retained and the narrowed top portions are protected from breakage when a person or objects move across the flooring surface 20. In addition, it will be understood that the portion of the planks below the ledges 26, 36 and 46 is substantially wider than the upper portion and serves to increase the rigidity of the frame, and its resistance to bending when the frame is laid over an uneven or unpacked ground surface.

In the preferred embodiment, the frame 12 is constructed of 2" by 6" planks of lumber. Preferably, the lumber is treated with a preservative to prevent rotting or insect infestation. For this reason, Wolmanized lumber is preferred in constructing the frame 12 of the present invention.

While the border planks 22, the stringer planks 32 and the cross planks 42 can be simply fastened together by nails, it will be understood that the interlocking engagement of the planks forms a rigid structure which resists warping and settling of the frame on an uneven ground surface. Thus, the apertures 16 retain their predetermined shape, and fixedly position the patio stones 18 with respect to each other. Moreover, the patio stones are stably supported at a predetermined level so that they form a substantially flat flooring surface.

In addition, since the openings extend through the frame, it will be understood that they provide a working space for the installation of bolts through the border planks for securing one or more borders 24 together, as shown diagramatically at 50 in FIG. 3. Thus, the size and shape of the completed patio deck can be varied as desired by selective arrangement of frame portions constructed in accordance with the present invention.

Referring again to FIG. 2, an additional feature which can be built into the frame comprises a grass-trim flange 52. As shown, a notch 54 is cut along the lower edge of the outer side of border timbers 22, and is dimensioned to receive the edge of a flange plate 56 extending outwardly from the border timber 22. The flange plate 56 is secured to the border timber by nails or other appropriate means. The plate 56 provides a ledge surface upon which a lawn mower wheel can be rolled, and which is wide enough so that the mower blade is positioned to cut the grass at the edge of the flange plate 56. The flange 52 thus forms a vegetation barrier preventing growth immediately adjacent the side of the border plank and thereby enables landscape trimming around the deck to be easily accomplished when the deck extends over a grassy ground surface.

Having thus described the important structural features of the present invention, it will be understood that the installation of the deck according to the present invention is substantially simpler and easier to accomplish than previously known deck constructions. Although a relatively flat area should be selected for placement of the deck, it is not necessary to level or tamp undulating or loose ground surface areas where the deck is to be installed. Thus, the deck construction of the present invention avoids the need for laborious preparation previously required to construct a flat-surfaced deck.

Moreover, although sod need not be removed from the ground surface where the deck is being installed, it may be desirable to cover the ground surface with the plastic sheet to prohibit the growth of vegetation beneath the deck which can often interfere with the decorative appearance of the patio stones. Once the plastic sheet is laid down, the frame, having been constructed in accordance with the disclosure, is laid on top of the plastic sheet so that the ledges 26, 36 and 46 face upwardly. Once the deck has been positioned on the sheet as desired, the patio stones are set into the apertures 16. Nevertheless, since the stones overlap the ledges, they block sunlight and retard growth of vegetation so that the use of a plastic sheet can be avoided. As a result, the frame is not subjected to the dangers incident to prolonged exposure to moisture and condensation which could be trapped in the deck structure by the plastic sheet.

Thus it will be understood that the deck provides a simple and effective means for laying patio stones to form a substantially flat and rigid flooring surface on a ground surface without requiring preparation of the ground surface or the complicated construction of slatted wood decks. In addition, the present invention avoids the problem of weed growth which often grow intermediate the patio stones of a stone deck and and detract from the appearance of the deck. Moreover, once the patio stones are set in place in the frame 12, the patio can be immediately used. In addition, it will be understood that since the patio stones are retained in position by the ledges and peripheral walls of the aperture 16, they need not be cemented or otherwise adhered in place. Accordingly, the patio stones are easily removed for replacement or to change the decorative effect of the patio by utilizing blocks of different colors in any desired arrangement. In addition, modular frame portions can be integrally secured together to form a patio deck of any desired shape or size.

Having thus described my invention, many modifications thereto will become apparent to those skilled in the art to which it pertains without departing from the scope and spirit of the present invention as defined in the appended claims. For example, constructing the frame of Wolmanized lumber renders the frame readily attachable to the support posts used for constructing raised wooden decks. Thus, the deck according to the present invention could conceivably be mounted well above the ground surface. Moreover, while the term plank has been used in the description of the preferred embodiment and claims, it should be understood that the term is not used restrictively so as to be limited to wood structures only, but can be a beam formed from a plastic material or other rigid material.

What is claimed is:

1. A deck structure for forming a flooring surface by supporting patio stone blocks in a fixed position above a ground surface, said deck comprising;

a plurality of fixedly dimensioned patio stone blocks, and a substantially horizontal frame defining a plurality of substantially vertically aligned openings, each opening dimensioned to receive a fixedly dimensioned patio stone, and including means for supporting a stone at one end of each opening, and wherein said frame comprises at least three border planks defining a closed, polygonal border, at least one stringer plank extending across said polygonal border, and at least one cross plank having a length dimensioned to wholly fit intermediate a first plank of said at least one stringer plank and a next adjacent second plank selected from the group consisting of stringer planks and border planks, and means for securing said cross plank to said first plank and said second plank;

wherein said means for supporting comprises an elongated notch extending along the upper interior edge of each border plank and an elongated notch extending along both upper edges of each of said at least on stringer plank and each of said at least one cross plank, said notches defining a peripheral ledge extending around said openings.

2. The invention as defined in claim 1 wherein each notch has a vertical depth less than the heights of the patio stone blocks.

3. The invention as defined in claim 2 wherein said patio stone blocks are formed of prestressed concrete.

4. The invention as defined in claim 3 wherein said patio stone blocks have been compressed.

5. The invention as defined in claim 1 and further comprising a flange plate and means for securing said flange plate to at least one of said border planks so that said flange plate extends outwardly from the bottom of said at least one border plank.

6. A deck frame structure for supporting a plurality of fixedly dimensioned patio stone blocks in a fixed position above a ground surface, said deck frame comprising;

a substantially horizontal frame defining a plurality of vertically aligned openings, each opening having at least an upper portion dimensioned to receive a fixedly dimensioned patio stone block and including means for supporting a patio stone block at the upper portion of each said opening;

wherein said frame comprises at least three border planks defining a closed, polygonal border;

at least one stringer plank extending across said polygonal border, and first means for securing said stringer plank to said polygonal border;

wherein said first means for securing comprises a vertically aligned recess adjacent each end of said stringer plank and open along the entire height of the interior side of said polygonal border for receiving an end of said stringer plank; and at least one cross plank and second means for securing each said cross plank to one of said at least one stringer planks, and wherein said second means comprises a vertically aligned recess open along the entire height of the stringer plank in said stringer plank for receiving an end of said cross plank therein.

7. The invention as defined in claim 6 and further comprising a flange plate and means for securing said flange plate to at least one of said border planks so that said flange plate extends outwardly from the bottom of said at least one border plank.

8. A deck structure for forming a flooring surface by supporting patio stone blocks in a fixed position above a ground surface, said deck comprising:

a plurality of fixedly dimensioned patio stone blocks, and a substantially horizontal frame defining a plurality of substantially vertically aligned openings, each opening dimensioned to receive a fixedly dimensioned patio stone, and including means for supporting a stone at one end of each opening, and wherein said frame comprises at least three border planks defining a closed, polygonal border, at least one stringer plank extending across said polygonal border, and at least one cross plank extending intermediate a first plank of said at least one stringer plank and a next adjacent second plank selected from the group consisting of stringer planks and border planks, and means for securing said cross plank to said first plank and said second plank;

said cross plank having first and second longitudinal ends, and wherein said cross plank securing means comprises a vertically aligned recess in each of said first and second planks, each recess being dimensioned to receive one of said longitudinal ends of said cross plank, and wherein said means for supporting comprises an elongated notch extending along the upper interior edge of each border plank and an elongated notch extending along both upper edges of each of said at least one stringer plank and each of said at least one cross plank, said notches defining a peripheral ledge extending around said openings.

9. The invention as defined in claim 8 wherein said frame is supported by the ground surface.

10. The invention as defined in claim 9 wherein said ground surface is covered with at least one sheet of plastic material.

11. The invention as defined in claim 8 wherein said closed polygonal border defines the periphery of a first modular, integral frame portion, and wherein said frame comprises at least one of said frame portions.

12. The invention as defined in claim 11 wherein said frame comprises at least two of said frame portions, and means for integrally securing said frame portions together.

* * * * *

UNITED STATES PATENT AND TRADEMARK OFFICE

CERTIFICATE OF CORRECTION

PATENT NO. : 4,628,645

DATED : December 16, 1986

INVENTOR(S) : Roman J. Tafelski, Jr.

It is certified that error appears in the above-identified patent and that said Letters Patent is hereby corrected as shown below:

Column 4, Line 49 - "42" should be --32--;

Column 4, Line 50 - "34" should be --42--;

Column 6, Line 33 - Delete "and";

Column 7, Line 19 - "on" should be --one--.

Signed and Sealed this

Twenty-eighth Day of April, 1987

*Attest:*

DONALD J. QUIGG

*Attesting Officer*

*Commissioner of Patents and Trademarks*